US005645215A

United States Patent [19]

Marendt et al.

[11] Patent Number: 5,645,215

[45] Date of Patent: Jul. 8, 1997

[54] SECURITY MAILBOX

[75] Inventors: Judy Marendt, 510 Whispering Pine Rd., Little Rock, Ark. 72210-5423; Kevin Brannon, Vilonia, Ark.

[73] Assignee: Judy Marendt, Little Rock, Ark.

[21] Appl. No.: 601,431

[22] Filed: Feb. 12, 1996

[51] Int. Cl.[6] ..... B65D 91/00

[52] U.S. Cl. ..... 232/17; 232/45

[58] Field of Search ..... 232/17, 39, 29, 232/24, 26, 31, 45; 292/251.5

[56] References Cited

U.S. PATENT DOCUMENTS

| | | | |
|---|---|---|---|
| 2,943,881 | 7/1960 | Duhm | 292/251.5 |
| 4,382,540 | 5/1983 | Kelly et al. | 232/17 |
| 4,726,512 | 2/1988 | White | 232/17 |
| 4,771,941 | 9/1988 | Bowman et al. | 232/35 |
| 4,901,913 | 2/1990 | Fischer | 232/17 |
| 5,031,828 | 7/1991 | Fischer | 232/39 |
| 5,215,283 | 6/1993 | Gould | 232/39 X |
| 5,400,960 | 3/1995 | Jeffs | 232/43.1 |
| 5,407,126 | 4/1995 | Coultas et al. | 232/17 |
| 5,476,220 | 12/1995 | Cohoon | 232/17 |
| 5,509,603 | 4/1996 | Hering | 232/39 |

OTHER PUBLICATIONS

Excerpted page from *Improvements* catalog, Fall, 1994, p. 15, Cleveland, Ohio.

*Primary Examiner*—Blair Johnson
*Attorney, Agent, or Firm*—Ray F. Cox, Jr.

[57] ABSTRACT

A security mailbox in which the conventional single door, rural mailbox is provided with a high strength enclosure and a latching lock so that when engaged the door of the mailbox may only be opened by a key. The door may also be held in a closed but unlocked position by a sliding magnetic catch that holds the door closed without engaging the latch but allows the door to be manually urged into the fully locked position. In the closed but unlocked position the door may be manually opened by the postal carrier. The postal carrier may manually close the door so that it moves past the closed but unlocked position and engages the latching lock in the fully locked position. A dual function mounting bracket is provided which has both a set of aligned holes for mounting the mailbox to a metal post with bolts and a set of offset holes for mounting the mailbox to a wooden post with screws.

2 Claims, 5 Drawing Sheets

SECURITY MAILBOX

BACKGROUND OF THE INVENTION

This invention relates to security mailboxes and, in particular, to single door, rural mailboxes.

It is well known that mailboxes are susceptible to pilfering. The problem is particularly acute in rural areas where a mailbox may be located at some distance from a residence. Furthermore, a rural mailbox may be left isolated and unobserved for extended periods of time.

The typical rural mailbox has a single door which is held closed by a simple door pull which engages a catch on the mailbox in a spring-like fashion. While such mechanisms are simple and durable, and are easily accessible by a postal carrier, they provide no means for locking the mailbox and thus are equally accessible to a passing thief.

It is therefore desirable to have a rural mailbox which resists destruction or violent entry and which may be locked after mail is placed in the mailbox so as to prevent unauthorized access. Locks may be easily provided for a mailbox, but the mailbox must remain accessible to the postal carrier both to retrieve outgoing mail and to deposit incoming mail. It is desirable, therefore, that a security rural mailbox may be opened once by a postal carrier and thereafter locked so as to prevent access by anyone other than the postal patron. Various solutions have been proposed for this problem. One common solution is to employ a double door on the mailbox. U.S. Pat. No. 4,382,540 issued to Kelly, et al. on May 10, 1983 for "Double Door Security Rural Mailbox" discloses a mailbox of this type having a locking mechanism such that a front door may be opened and closed once by the mail carrier before being secured in a locked position. Thereafter, the front door may only be unlocked by unlocking and opening the rear door.

A variation on this concept is disclosed in U.S. Pat. No. 5,400,960 issued to Jeffs on Mar. 28, 1995 for "Letter Locker Mailbox Assembly." Jeffs discloses a mailbox having an upper mail receiving compartment communicating by a mail chute to a lower outgoing mail tray. The door to the upper mail receiving compartment is held closed by a magnetic strip. The upper door is sized so that a would-be thief is unable to reach in to the mail stored in the outgoing mail tray. The mail receiving compartment is secured by a locked door.

Another solution to this problem is disclosed in U.S. Pat. No. 4,726,512 issued to White on Feb. 23, 1988 for "Self Locking Means." White discloses a locking mechanism whereby an inner lock box is formed within a standard rural mailbox. The mailbox may be opened one time after which the inner lock box is placed in a closed and locked position such that a key is required to reopen the inner lock box.

A further solution to this problem is disclosed in U.S. Pat. No. 5,407,126 issued to Coultas, et al. on Apr. 18, 1995 for "Single Door Security Mailbox." Coultas, et al. disclose a locking mechanism for a single door rural mailbox. The lock is provided with a set position allowing the mail carrier to open the closure once after which the closure is closed with sufficient force so that the locking mechanism passes the set position and engages in a locked position. Thereafter, the closure may only be unlocked by the owner with a key.

SUMMARY OF THE INVENTION

In one embodiment of the present invention a single door, rural mailbox of conventional type is provided with a high strength enclosure and a latching lock so that when engaged the door of the mailbox may only be opened by a key. The mailbox is further provided with means for releasably holding the door of the mailbox in a closed but unlocked position. In the closed but unlocked position the door may be manually opened by the postal carrier for removal of outgoing mail and delivery of incoming mail. The postal carrier may then manually close the door so that it moves past the closed but unlocked position and engages the latching lock in the fully locked position wherein the door may only be opened by a key.

In one embodiment of the present invention, the door of the mailbox is held in the closed but unlocked position by a sliding magnetic catch. The sliding magnetic catch allows the door of the mailbox to be held closed without engaging the latch on the lock. When the door is to be fully locked, however, the sliding nature of the magnetic catch allows the door to be manually urged into the fully locked position wherein the latch of the lock engages a striking member on the mailbox.

Certain alternative embodiments of the present invention provide for means for mounting the mailbox onto either a wooden post or a metal post. A dual function mounting bracket is provided which has both a set of aligned holes for mounting the mailbox to a metal post with bolts and a set of offset holes for mounting the mailbox to a wooden post with screws. The mounting arrangements ensure further security to the mailbox by providing for a firm and solid attachment of the mailbox to the support post, whether it be wood or metal.

Further objects and advantages of the present invention will become apparent from consideration of the detailed description of the preferred embodiment in conjunction with the drawings described as follows.

DETAILED DESCRIPTION OF THE PREFERRED EMBODIMENTS

Figure 1:
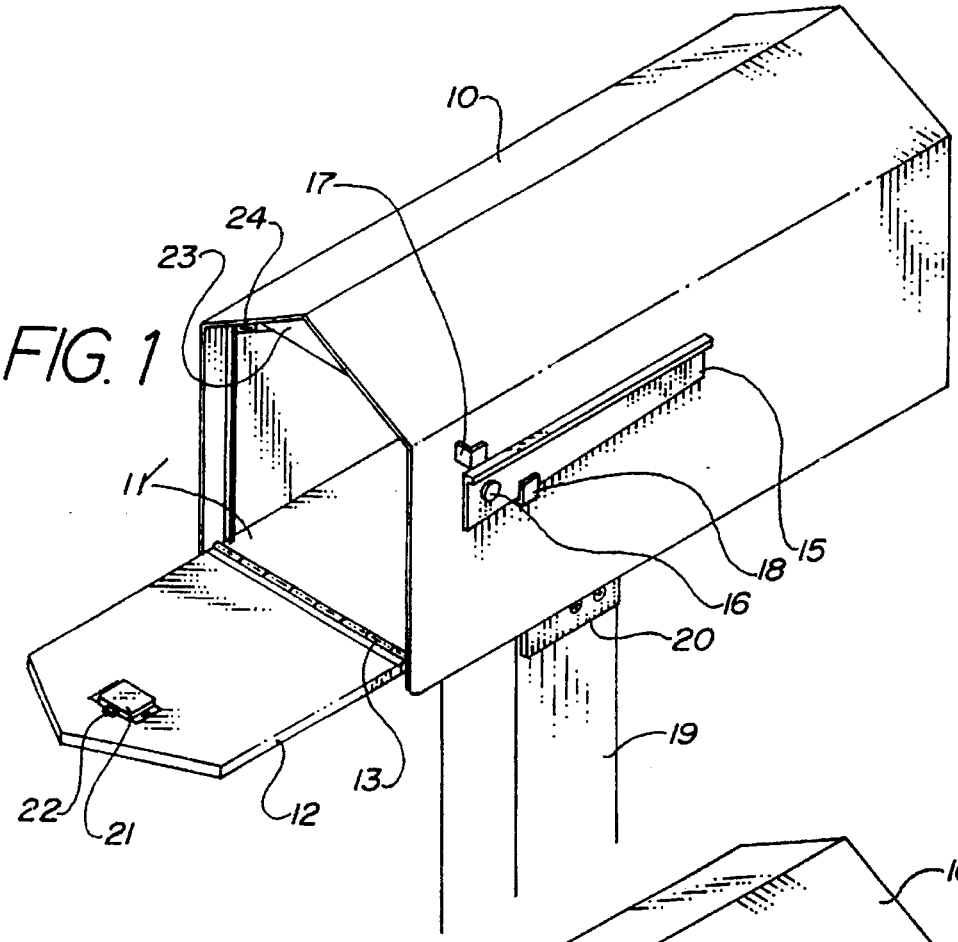
FIG. 1 is a perspective view of the present invention showing the door in the open position.
Figure 2:
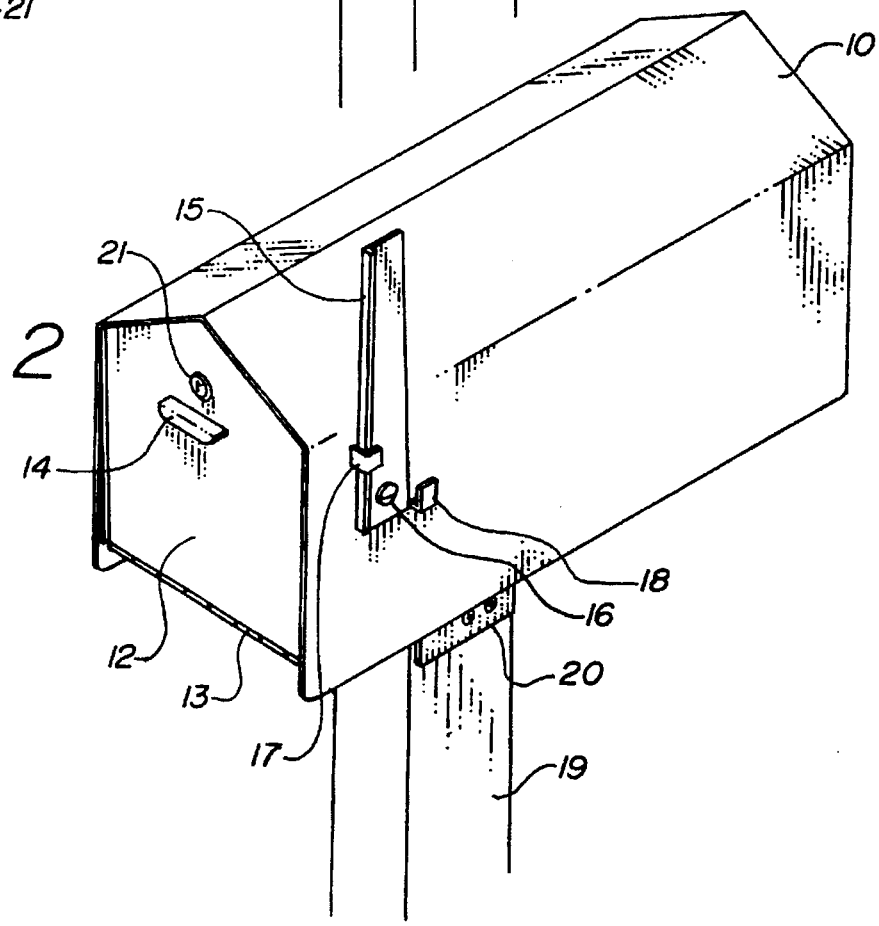
FIG. 2 is a perspective view of the present invention showing the door in a closed position.
Figure 4:
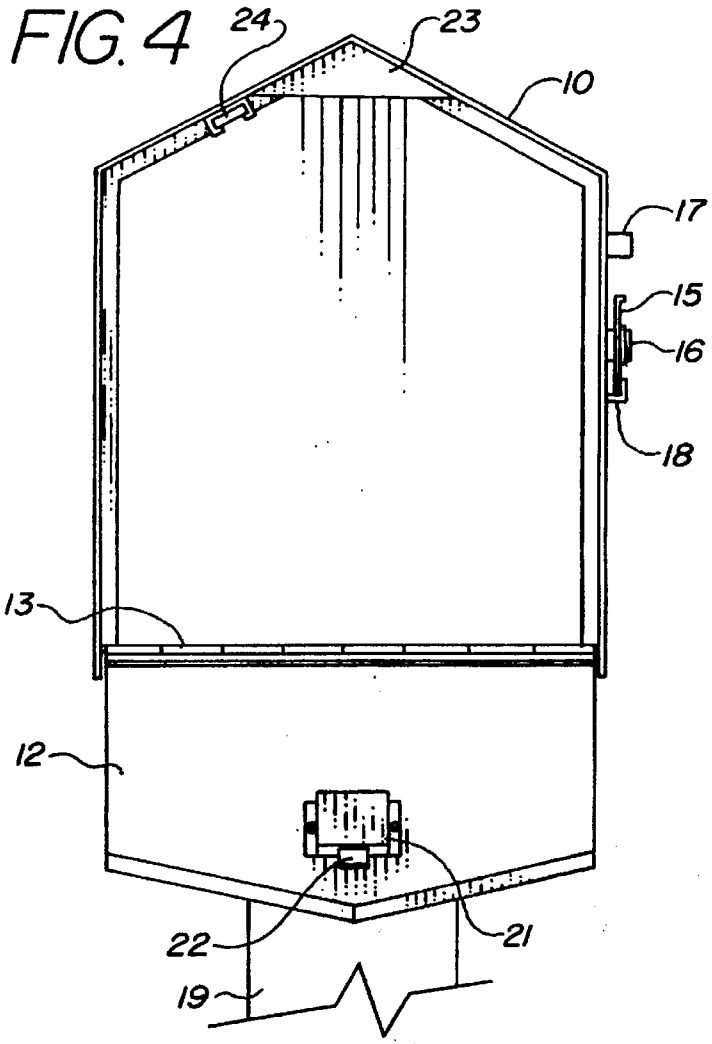
FIG. 4 is a front elevation view of the present invention with the door in the open position.
Figure 3:
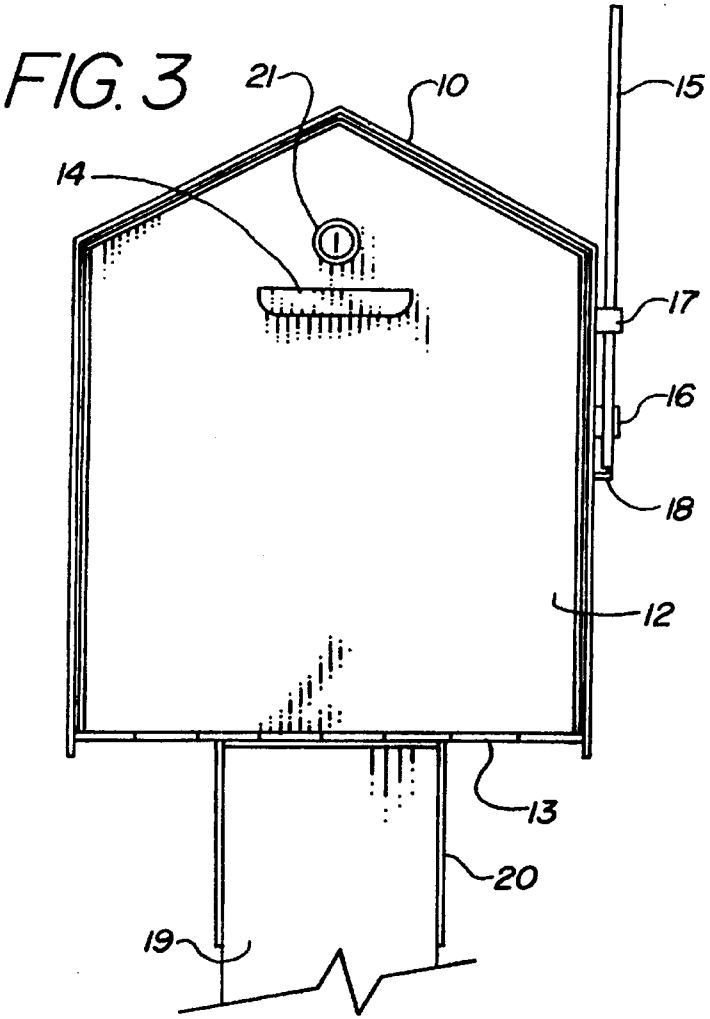
FIG. 3 is a front elevation of the present invention with the door in a closed position.

The general appearance of the present invention may be described with reference to FIGS. 1 through 4. The enclosure 10 is in a typical configuration for a rural mailbox. The present invention is not, however, limited to the precise configuration shown in FIGS. 1 and 2 and subsequent figures. Various configurations of enclosures would be useable with the present invention. It is desirable that any configuration be construction of such materials and in such a manner as to resist the attack of thieves or vandals.

As would be typical of a rural mailbox, the present invention is provided with a floor 11 and an end wall (not shown). The door 12 is mounted to the floor 11 by a hinge 13. The hinge 13 is advantageously a stainless steel, no rust, full travel hinge, although the present invention is not limited to such a hinge.

The enclosure 10, floor 11, door 12 and end wall thus define an enclosed space for depositing mail. The floor 11 may advantageously be provided with a diamond decking or similar construction to keep mail dry.

The mailbox employed in the present invention may be constructed in various dimensions depending on the particular application. However, the scope of the present invention is not limited to any particular dimensions. Likewise, the mailbox employed in the present invention may be constructed of various materials and in various strengths. It is desirable, however, for security purposes to construct the mailbox of high strength materials such as steel. It is also desirable that the steel be of sufficiently heavy gauge to discourage vandalism. Steel construction in 14 or 16 gauge has been found to be effective. Heavier gauges are desirable for mailboxes constructed in larger dimensions so as to provide the most desirable structural rigidity.

The door 12 is provided with a door pull 14. Although not necessary to the practice of the present invention, it is desirable that the door 12 be somewhat recessed into the enclosure 10. A recess in the range of approximately 1 inch has been found to be effective in improving the security and weather proofing of the closure of the door 12.

In keeping with the standard construction of rural mailboxes, the present invention is provided with a red flag 15. The red flag may be moved in an up position shown in FIG. 2 and a down position shown in FIG. 1. The red flag 15 pivots about pivot means 16. Various pivot means 16 may be employed in the practice of the present invention, although it has been found that an industrial grade nylon bushing is reliable in operation. Pivot means 16 could also comprise an aluminum jam nut with cadmium-coated rust-resistant washer. Optionally the red flag 15 may be provided with an upward flag stop 17 and/or a downward flag stop 18. The rural mailbox embodying the present invention may be mounted to a post 19 by a mounting bracket 20 which is rigidly affixed to the mailbox and may be assembled to the top of the post 19 as will be described more fully hereinafter. It should be noted that the mounting bracket 20 is adaptable to being assembled to either a 4×4 wooden post or to a metal post of similar dimensions. A 4×4 wooden post actually measures 3½ inches by 3½ inches. It is desirable that the rural mailbox embodying the present invention be provided with a weather and corrosion resistant finish. It has been determined that a powder coat finish or an epoxy paint finish will perform satisfactorily, although the present invention is not limited to the use of these particular finishes.

The door 12 is provided with a spring latch lock 21. Various types of spring latch lock would be usable in the present invention. Spring latch locks that have desirable characteristics and that have been found to be acceptable in the application of the present invention include the Master-Lock model numbers 1719 and 1714. The spring latch lock 21 has a spring loaded latching member 22 which is positioned so as to engage a striking member 23 which is rigidly affixed to the enclosure 10. When the latching member 22 engages the striking member 23 as will be described more fully hereinafter, the door 12 may only be opened by using a key to operate the spring latch lock 21. Shown in FIG. 1 and described more fully hereinafter is a sliding magnetic catch 24. The sliding magnetic catch is advantageously constructed with an aluminum, no-rust casing. Optionally the enclosure 10 may be provided with an internal stiffening member 25 adjacent to the door 12.

The locking mechanism of the present invention may be described with reference to FIGS. 5 through 10. In the preferred embodiment of the present invention, the sliding magnetic catch 24 comprises a housing 26 which contains a magnet 27. The housing 26 is provided with a pair of longitudinal slots 28. The sliding magnetic catch 24 is attached in a sliding fashion to the housing 10 by means of fasteners 29 which pass through the longitudinal slots 28 and are affixed to the enclosure 10 so as to allow the sliding magnetic catch to slide longitudinally along the longitudinal grooves 28 with respect to the fasteners 29 and the enclosure 10.

Figure 5:
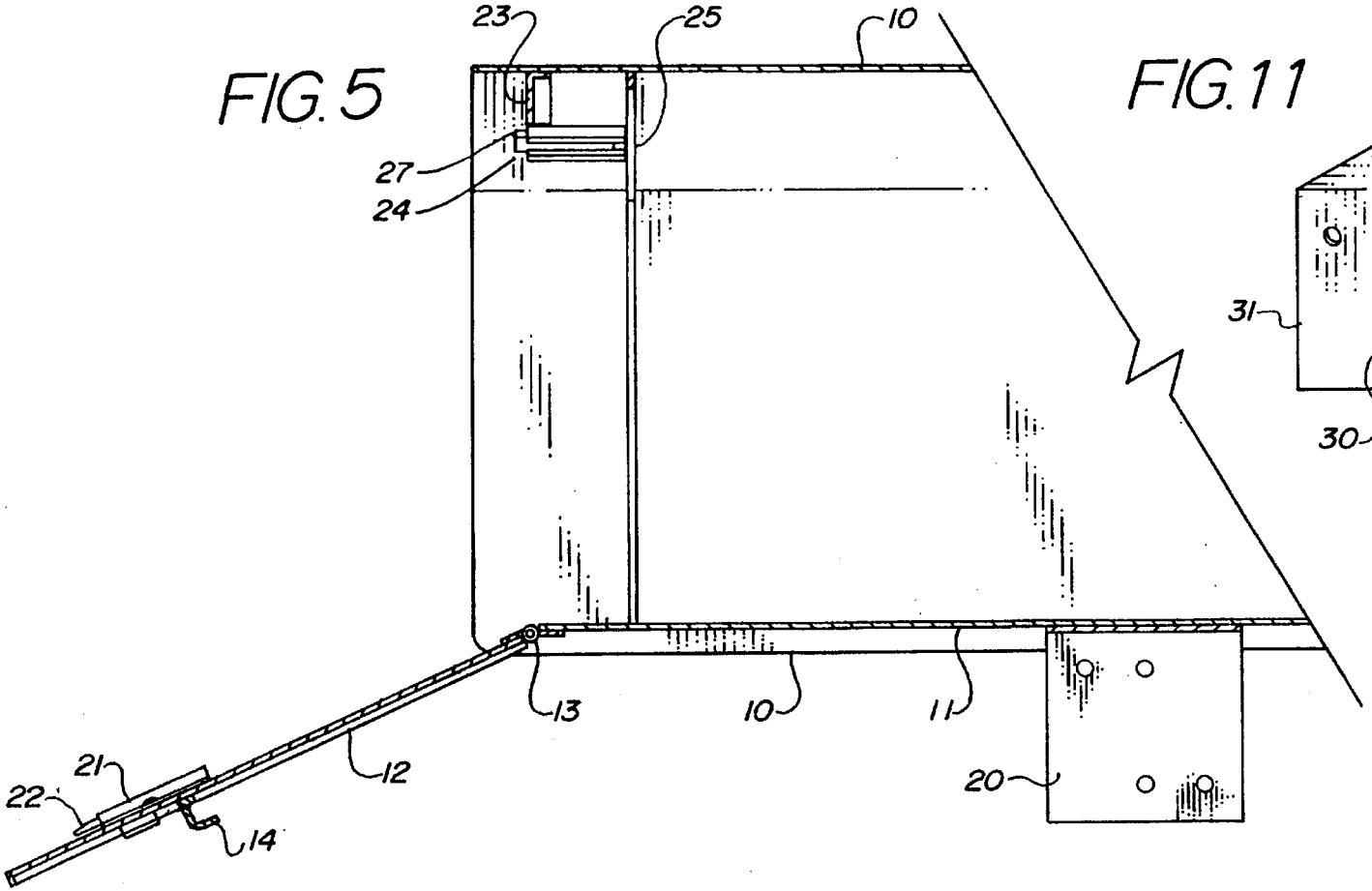
FIG. 5 is a partial sectional left side elevation view of the present invention with the door in the open position.
Figure 8:
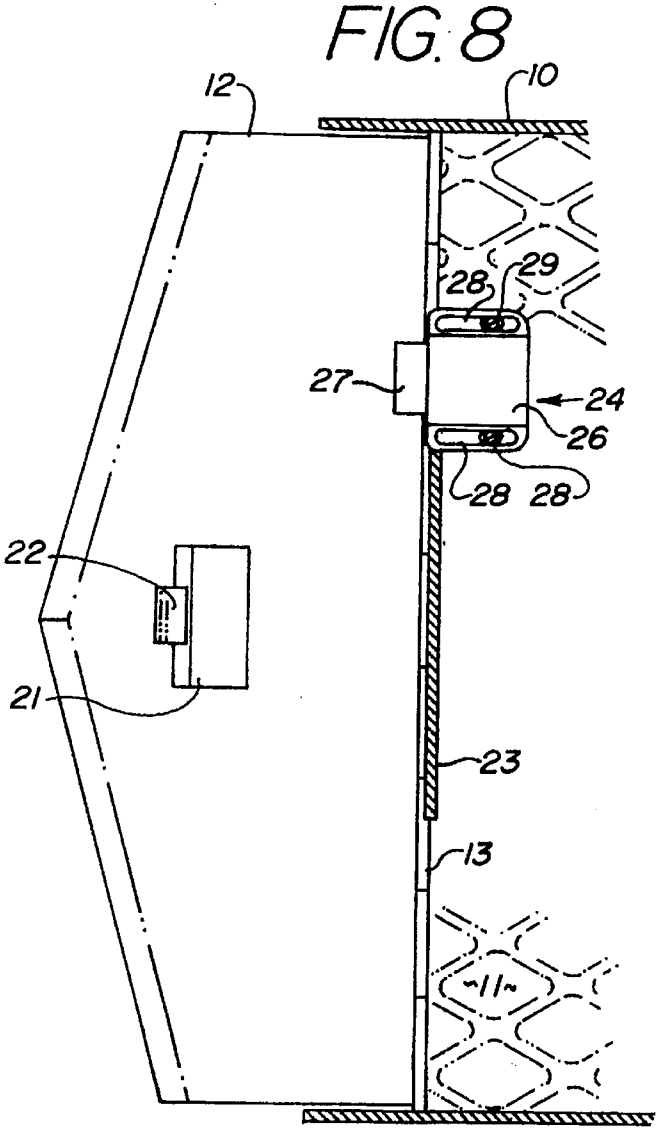
FIG. 8 is a partial sectional plan view of the present invention with the door in the open position.

The rural mailbox of the present invention has three operative positions. The open position is illustrated in FIGS. 5 and 8. In this position the door 12 is opened and access to the interior space of the mailbox is available for either retrieving or depositing mail.

Figure 6:
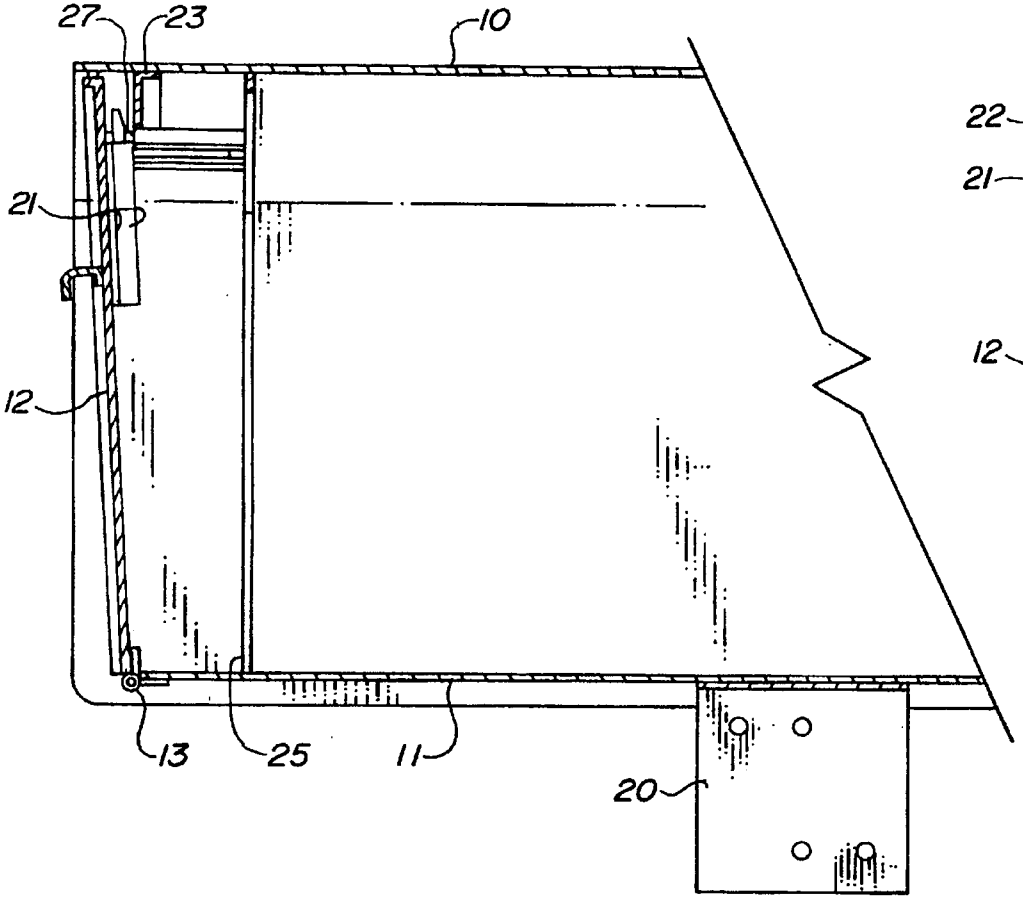
FIG. 6 is a partial sectional left side elevation view of the present invention with the door in the closed but unlocked position.
Figure 9:
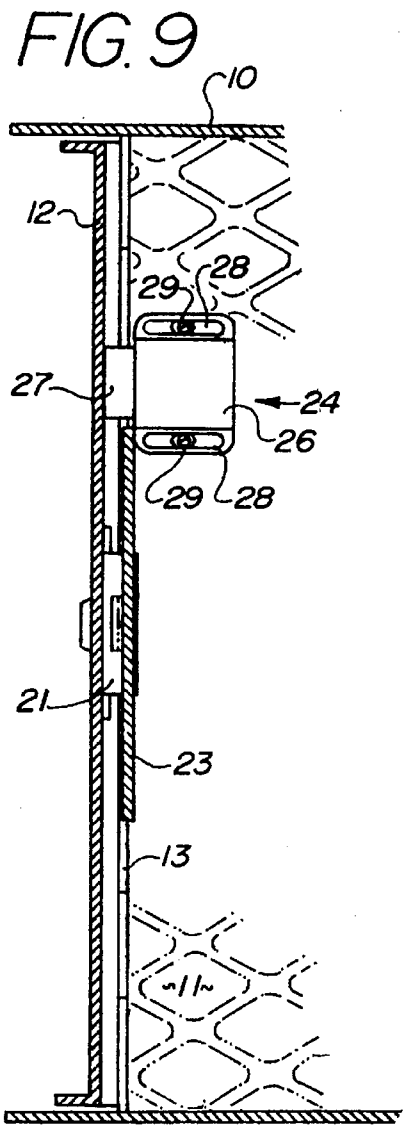
FIG. 9 is a partial sectional plan view of the present invention with the door in the closed and unlocked position.

The second operative position is the closed but unlocked position shown in FIGS. 6 and 9. In this position the sliding magnetic catch 24 and the door 12 are brought into contact. The door 12 is either constructed of a magnetic material, such as steel, or a suitable magnetic material is affixed to the door 12 so that the door 12 magnetically adheres to the magnet 27. In the closed but unlocked position, the sliding magnetic catch 24 is extended toward the door 12 so that the latching member 22 of the spring latch lock 21 does not engage the striking member 23. It is necessary for the sliding magnetic catch 24 to be in an extended or forward position so that the magnet 27 may engage the door 12 without the spring latch lock 21 becoming engaged with the striking member 23. This may be accomplished by manually moving the sliding magnetic catch 24 to the appropriate position. Typically, however, this is not necessary since the door 12 adheres magnetically to the magnet 27. Therefore, when the door 12 is opened, the sliding magnetic catch will naturally be pulled forward until the magnetic attraction with the door 12 is broken.

Various releasable engaging means may be employed in the practice of the present invention in addition to the sliding magnetic catch described above. Any means to hold the door 12 releasably in a position in which the door 12 is effectively closed and which is nevertheless held from a position in which the latch on the spring latch lock catches, would be suitable for the present invention. For example, springs could be employed to bias the door 12 in the closed but unlocked position. Other releasable engaging means includes spaced dimples in the walls of the enclosure 10 to catch the door 12. Such dimples would functionally act as springlike detents due to the natural flexibility of the walls of the enclosure 10. Other examples of releasable engaging means are considered to be encompassed within the scope of the present invention.

Figure 7:
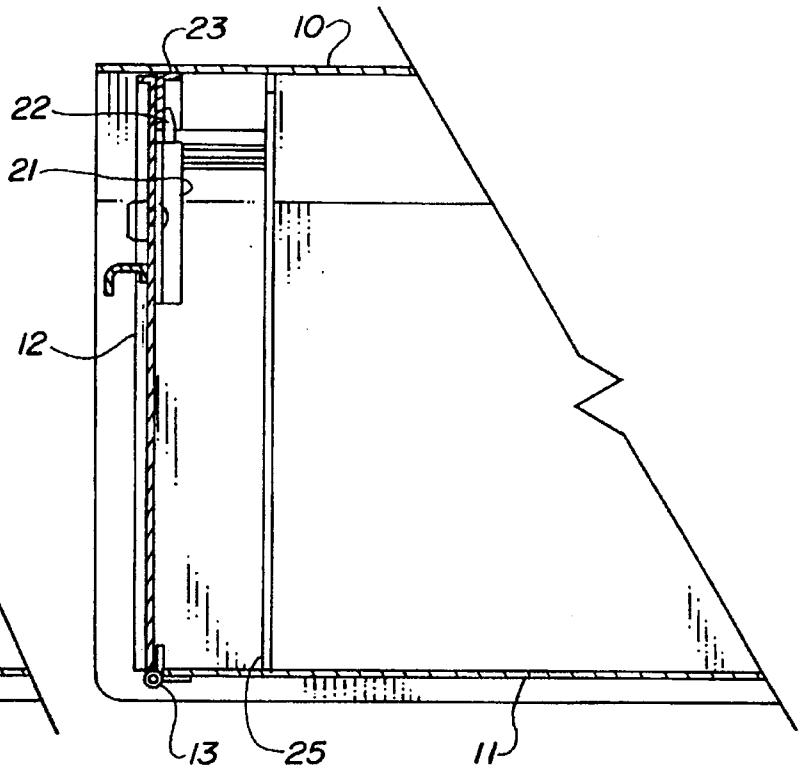
FIG. 7 is a partial sectional left side elevation view of the present invention with the door in the closed and locked position.
Figure 10:
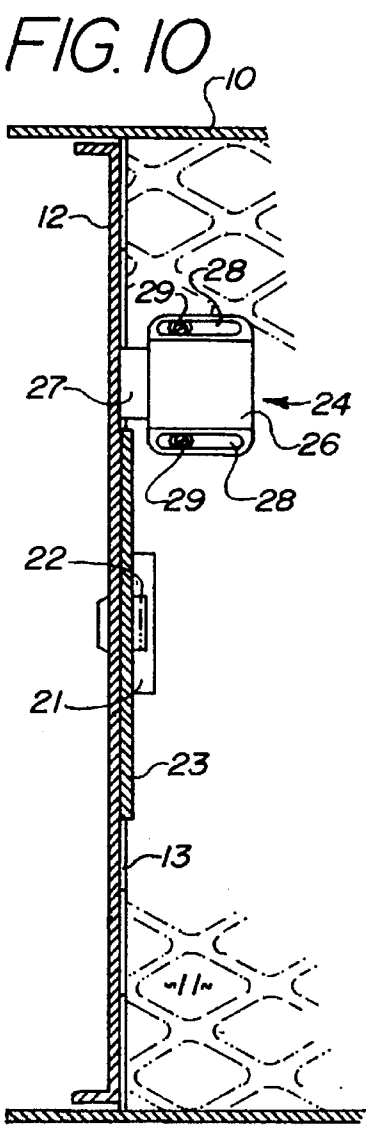
FIG. 10 is a partial sectional plan view of the present invention showing the door in the closed and locked position.

The door 12 may be left in the closed but unlocked position so that the postal carrier may obtain access to the interior space of the mailbox for removing or depositing mail therein. The postal carrier may then close the door 12 so that the door 12 contacts the magnet 27. The door 12 may then be manually urged into the closed and locked position as shown in FIGS. 7 and 10. In this, the third operative position, the door 12 contacts the sliding magnetic catch 24 and the sliding magnetic catch 24 is moved longitudinally along the longitudinal grooves 28 until the latching member 22 of the spring latch lock 21 contacts and engages the striking member 23. At this point the door 12 is in the fully closed and locked position. Access to the interior space of the mailbox may then be obtained only by using a key to unlock the spring latch lock 21. Having unlocked the spring latch lock 21 and opened the door 12, the user may retrieve any mail deposited in the mailbox and may then return the door 12 to the closed but unlocked position.

Figure 11:
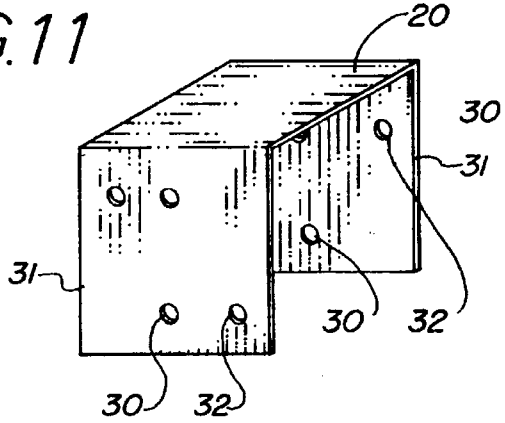
FIG. 11 is a perspective view of the mounting bracket.

In a further embodiment of the present invention, the mounting bracket 20 is provided with means for attaching the mailbox to either a 4×4 wood post or a metal post of equivalent dimension. In attaching a mailbox to a metal post, it is desirable to use a mounting bracket which will accept bolts which pass through the mounting bracket and the metal post. In order to achieve this type of assembly, the mounting bracket 20 of the present invention is provided with a plurality of aligned bolt holes 30 as shown in FIG. 11. Since the bolt holes 30 are aligned, bolts may be employed which pass through both legs 31 of the mounting bracket 20. If the mounting bracket 20 is to be used to attach the mailbox to a wood post, however, aligned holes are not desirable. This is due to the fact that mounting the mailbox to a wooden post entails the use of screws which pass through the mounting bracket and into the wood of the post. Since screws are used from both sides of the mounting bracket 20, alignment of the holes would possibly allow the screws to interfere or to cause a split in the wooden post. To overcome this problem, a set of offset screw holes 32 are provided such that no single offset screw hole 32 is directly aligned with any other offset screw hole 32. For larger and heavier mailboxes, gussets from the bracket 20 to the floor of the mailbox may be desirable to provide greater strength and durability.

The present invention has been described with respect to certain preferred and alternative embodiments which are considered to be exemplary only and not limiting to the full scope of the present invention as set forth in the appended claims.

What is claimed is:

1. A security mailbox, comprising:

an enclosure having an interior space accessible by a hinged door having at least an open position, a closed and unlocked position, and a closed and locked position;

a lock mounted to said hinged door, said lock having a latching member;

a striking member affixed to said enclosure whereby said latching member engages said striking member when said hinged door is in said closed and locked position; and releasable engaging means for holding said hinged door in said closed and unlocked position whereby said hinged door is manually movable to either said open position or said closed and locked position;

wherein said releasable engaging means comprises a magnetic catch slidably mounted to said enclosure whereby said hinged door is releasably held by said magnetic catch in said closed and unlocked position and further whereby sliding movement of said magnetic catch allows said hinged door to be manually urged into said closed and locked position.

2. The security mailbox of claim 1 further comprising means for mounting to either a wooden or metal post, comprising a mounting bracket having a pair of legs depending from said enclosure and deployed to opposite sides of the post, a set of aligned bolt holes in said legs for mounting the mailbox to a metal post, and a set of offset screw holes in said legs for mounting the mailbox to a wooden post whereby screws driven from opposite sides of said wooden post through said offset screw holes are not aligned along an axis.

* * * * *